US005398735A

United States Patent [19]

Lagache

[11] Patent Number: 5,398,735

[45] Date of Patent: Mar. 21, 1995

[54] FILLING REGULATOR FOR LIQUID STORAGE TANK

[75] Inventor: Roland Lagache, Lege, France

[73] Assignee: Lafon S.A., France

[21] Appl. No.: 870,025

[22] Filed: Apr. 17, 1992

[30] Foreign Application Priority Data

Apr. 17, 1991 [FR] France ..... 91 04710

[51] Int. Cl.[6] ..... B65B 1/30; B65B 31/00; B67C 3/02

[52] U.S. Cl. ..... 141/95; 141/198; 141/212; 141/216; 141/220; 141/229; 137/409

[58] Field of Search ..... 137/409, 411, 427, 428, 137/527; 141/94, 95, 192, 198, 199, 200, 201, 212, 213, 216, 218, 220, 221, 222, 223, 224, 228, 229; 138/39, 41, 42; 4/591, 300.3

[56] References Cited

U.S. PATENT DOCUMENTS

| | | | |
|---|---|---|---|
| 2,507,545 | 5/1950 | Samiran | 141/213 |
| 2,662,553 | 12/1953 | Dimmock | 138/39 |
| 3,762,438 | 10/1973 | Litchfield | 137/527 |
| 4,881,280 | 11/1989 | Lesikar | 4/591 |
| 4,986,320 | 1/1991 | Kesterman et al. | 141/198 |
| 4,998,571 | 3/1991 | Blue et al. | 141/198 |
| 5,163,470 | 11/1992 | Maeshiba | 141/198 |
| 5,174,345 | 12/1992 | Kesterman et al. | 141/198 |
| 5,241,983 | 9/1993 | Lagache | 141/198 |

FOREIGN PATENT DOCUMENTS

| | | |
|---|---|---|
| 0312320 | 4/1989 | European Pat. Off. . |
| 570543 | 5/1924 | France . |
| 8900241 | 11/1989 | WIPO . |

*Primary Examiner*—Ernest G. Cusick
*Assistant Examiner*—Steven O. Douglas
*Attorney, Agent, or Firm*—Jenner & Block

[57] ABSTRACT

A filling regulator for a liquid storage tank of the type according to which a float is displaced vertically in the float chamber provided in the body of the regulator. The regulator includes a deflector slanted over the inner wall of the body and installed above the gate at a far enough distance above the float chamber to allow the gate to be positioned in the full-open position. The deflector includes slanted, spaced-apart blades which are joined at their lower ends by a protective base.

9 Claims, 5 Drawing Sheets

FILLING REGULATOR FOR LIQUID STORAGE TANK

The present invention concerns a filling regulator for a liquid storage tank.

It is known to equip a sunken or aerial storage tank used for receiving liquid with a filling regulator whose function is to stop the tank from being filled when the liquid in said tank reaches a predetermined level, to prevent it from overflowing, which would be detrimental to the environment of the tank. This is particularly investigated when the tank to be filled is located in a service station discharging various types of hydrocarbons.

The simplest regulators in terms of structure include a body; a gate mounted in said body and movable between an open position, corresponding to the filling of the tank, and a closed position, corresponding to the action of stopping the filling of said tank; and a float, connected to said gate, which follows the liquid rise in the tank so as to close the gate when a predetermined liquid level is reached in the tank.

Numerous improvements have been made to the regulators, depending on whether or not the Storage tanks are provided with inspection holes or an inlet hole for positioning the regulators inside the storage tank.

In U.S. Pat. Nos. 1,289,490 and 1,689,066, the regulators include a tube body filled with an internal partition to delimit the adjacent chambers placed side-by-side, one of the chambers being used as a passage for the liquid to be used to fill the tank and the other one for receiving a float which is connected to a gate capable of being displaced from an open position, corresponding to a low liquid level in the tank, located below the float, to a closed position, corresponding to a high liquid level in the tank, but always located below the closing gate. In this prior art, the gate is always reopened manually. Additionally, and this is the most serious drawback, there is no possibility of reopening the gate when the filling agent does not stop the filling when the gate is in its closed position.

Other regulators have been recently proposed. Such regulators are, for example, described in French Patent Application No. 89 16 604, Application PCT-FR-89 00 241, European Patent Application No. 03 12 230 and U.S. Pat. No. 4,667,711.

Each of the regulators described in these patents or patent applications includes a float which is connected to the gate, so that while the liquid is rising in the tank, it is farther away from the body of the regulator. When the regulator is introduced into the inlet hole of the tank, the float is lodged at least partially in the body to decrease the overall size of the regulator.

However, such regulators, due to the clearance of the float inside the body, cannot fill the tank to its maximum level. Actually, it is necessary to keep a minimum space between the upper wall of the tank and the maximum upper position of the float.

The present invention aims to correct the above-mentioned drawbacks and aims to offer a regulator which is simple in its construction, compared to the more complex construction of regulators of the prior art and, permits a quasi-total filling of the storage tank.

The present invention refers to a regulator of the type including: a body arranged at least partially inside said tank and in which a separation partition is installed delimiting an passage conduit for the liquid arid a chamber for the float, a gate installed above the passage conduit and the float chamber, said gate being capable of being displaced between an open position and a closed position, e gate seat provided in the body and receiving said gate in closed position, said float being displaced vertically by the rise of the liquid in the tank and acting upon said gate by means, characterized in that a deflector slanted over the inner wall of the body is installed above the gate at a far enough distance above the float chamber to allow the gate to be positioned in the full-open position, said deflector being made up of blades, which are, on the one hand slanted and separated from each other, and on the other hand, joined at their lower end at a protective base of the gate in the full-open position.

One advantage of the present invention lies in the fact that not only the entire volume of the tank may be used for storing liquid, but one does not risk altering the operation of the regulator and/or damaging it due to a constant or repeated contact of the float during its upward movement on one of the walls of the tank when the regulator is lodged near said wall.

Another advantage of the present invention lies in the fact that even small amounts of liquid may be allowed in the body of the regulator.

Other advantages and features will be brought forth and become more obvious by reading the description of a preferred embodiment mode of the invention as well as the attached drawings in which.

Figure 1:
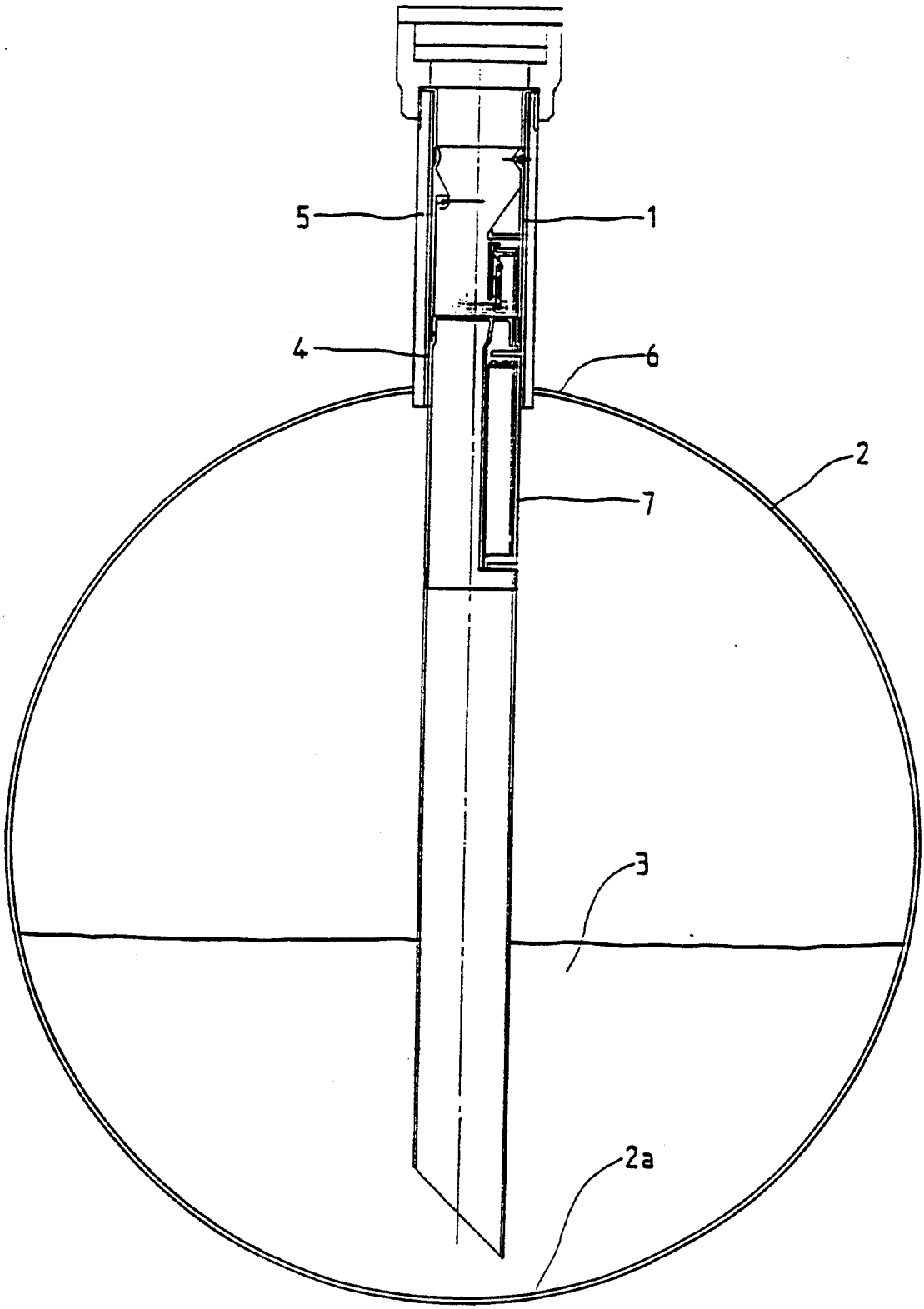
FIG. 1 is a sectional view of a storage tank fitted with a regulator according to the present invention.

The filling regulator (1), according to the present invention, is used to equip storage tank (2) for a liquid (3), such as a hydrocarbon, tank (2) being fitted, for example, with entry hole (4) delimited by the inner section of inlet tube (5) integral with the upper wall (6) of tank (2) (FIG. 1).

Filling regulator (1) includes body (7), having a generally circular profile, which is at least partially lodged inside said tank (2). Body (7) is divided into two parts (8) and (9) on the inside. Part (8), fitted between outer wall (10) of body (7) and inner separation partition (11), is made up of a passage conduit for the filling liquid which takes place from top to bottom from inlet hole (4) to the bottom (2a) of the tank. Part (9) is delimited by separation partition. (11) and wall (12) and is made up of a chamber to lodge and protect float (13). Outer wall (12) of the body is fitted with at least one upper opening (14) and can include another lower opening (15) fitted below the lowest position of float (13).

Figure 2:
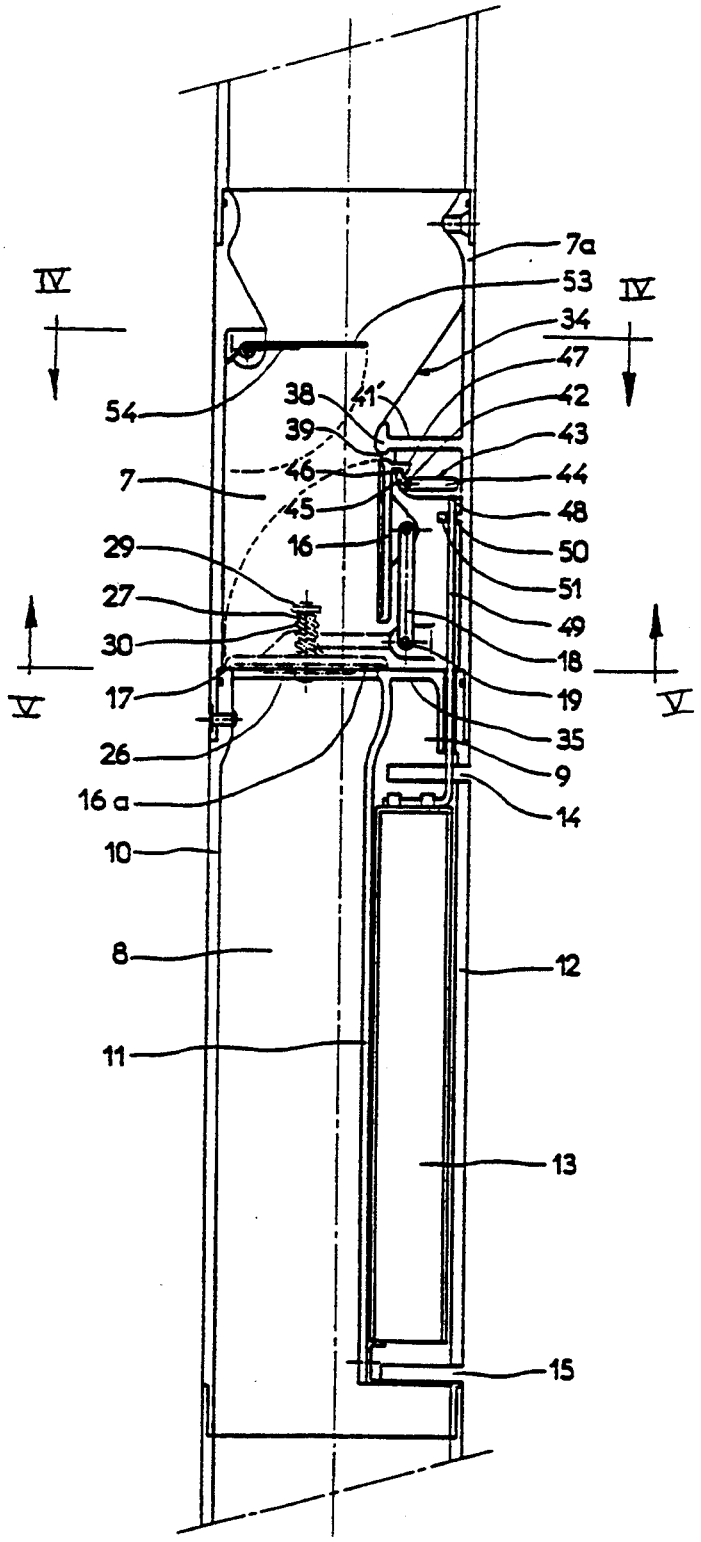
FIG. 2 is a sectional view of the regulator according to the invention.

Gate (16) is installed above partition (11) and float chamber (9), the gate (16) being capable of moving between a vertical position corresponding to the full-opening of passage (8) and a horizontal position corresponding to the full-closing of said passage, the two positions being represented, for clarity, in the same FIG. 2. Gate seat (17) is provided on the upper part of passage (8) and is made up of a bearing seat for gate (16).

Figure 5:
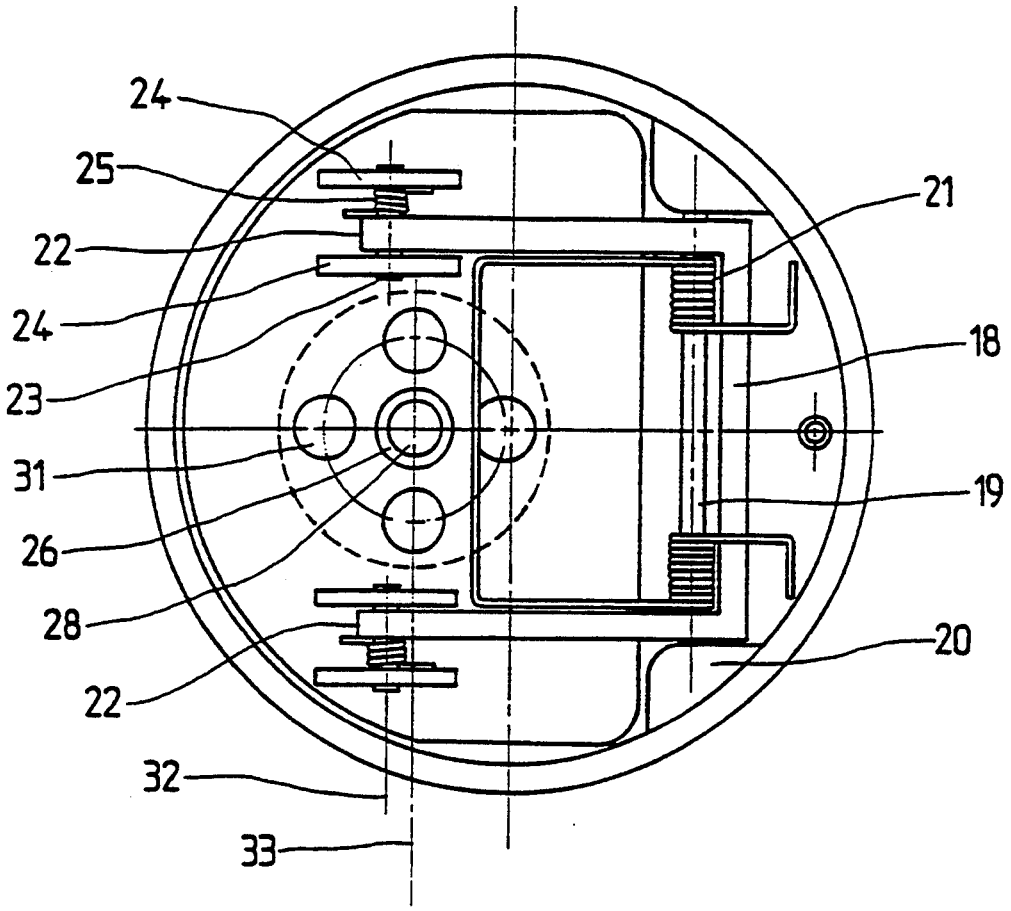
FIG. 5 is a sectional view of the regulator according to V—V of FIG. 2.

Stirrup (18) (FIG. 5) is installed upon pivoting axis (19), which is supported at its two ends on supports (20).

Spring (21) is installed so that gate (16) is constantly pulled back to the full-open position. Ends (22) of stirrup (18) are hinged to small axes (23), each one placed between two lugs (24). Possibly, spring (25) is placed between end (22) and far lug (24).

A shock wave damping valve (26) is provided on face (16a) of gate (16). Damping valve (26) is installed at the end of hollow rod (27) passing through hole (28) provided in said gate. Nut (29) for adjusting the setting of spring (30) is screwed to rod (27).

When gate (16) closes over seat (17), a shock wave is suddenly created above gate (16), said shock wave propagating into a filling hose connecting the regulator to a tank truck or other liquid source. Without the, damping valve (26), the propagation of the shock wave between gate (16) and a control valve of the tank truck would cause successive openings and closings of the gate against its seat. The damping valve (26) opens when the shock wave is created, after the sudden closing of gate (16); accordingly, a drop in the overpressure is created and the shock wave is diminished very rapidly and therefore gate (16) does not have a tendency to open. It is therefore noticed that damping valve (26) only opens when the pressure difference prevailing on either side of gate (16) is greater than a predetermined value which is given by setting spring (30).

Passages (31), whose positioning and function are described in prior documents, are provided ion gate (16) and allow the liquid to pass when valve (26) is opened.

Axes (23) are located on like (32) which is offset-relative to the axis of symmetry (33) of the gate (16) or at least relative to the diameter, parallel to line (32), of damping valve (26) which is, preferably, installed at the center of gate (16).

Deflector (34), cast-mounted with upper part (7a) of body (7), is arranged above upper bottom (35) of float chamber (9) and at such a distance that gate (16) can operate during its displacements, and, in particular, occupy the full-open position, as depicted in FIG. 2.

Figure 3:
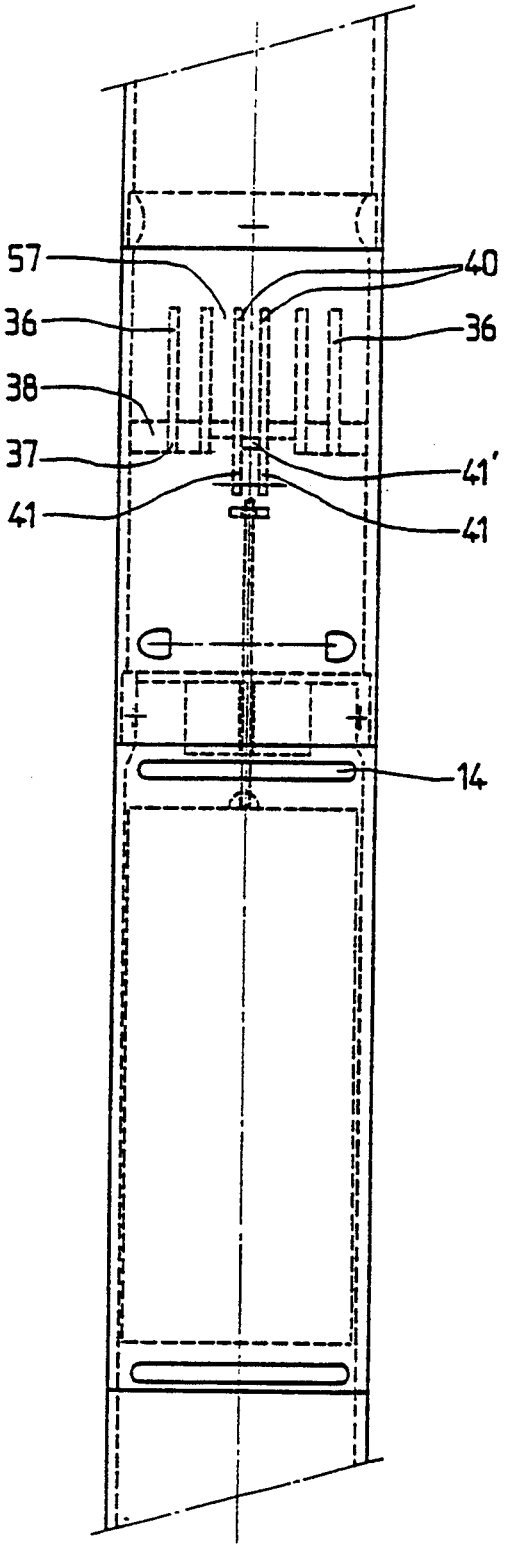
FIG. 3 is a side view of the regulator-with the deflector represented in dotted lines

Deflector (34) is made up, FIG. 3, of blades (36) which are slanted from inner wall (7*a*) toward the center of body (7). Blades (36) are joined, by lower ends (37) to base (38) appearing in the form of an arc of a circular-shaped pad which also provides protection for the upper edge (39) of gate (16) which is placed under deflector (34). In this way, upper edge (39) is not exposed to the action of the fluid circulating in the regulator. Two central blades (40) of deflector (34) are longer than the others and have prolongations (41) directed downward and behind gate (16). Prolongations (41) are used to receive axis (42) upon which catch (43) is mounted to freely pivot and which constitutes a locking component and has lever arm (44), which is much larger than the other arm (45) fitted with hook (46) cooperating with hook (47) provided on the back side of gate (16). The respective lengths of the lever arms of the catch are such that catch (43) returns to its horizontal position under its own weight, when it is no longer integral with gate (16) and when it is not thrust against the upper end ( 48 ) of inverted L-rod ( 49 ) which is fastened to the peak of float (13). Rod (49) is guided into hole (50) provided in leg (51) integral with wall (12).

The blades are spaced between each other and their spacing is less than the diameter of a gauge measuring the height of the liquid in tank (2).

Prolongations (41) of the central blades (40) are joined by small linking plate (41') which is provided above catch (43) and which prevents the liquid from passing through deflector (34) from activating said catch which consequently is not exposed to the pressure of the fluid.

Figure 4:
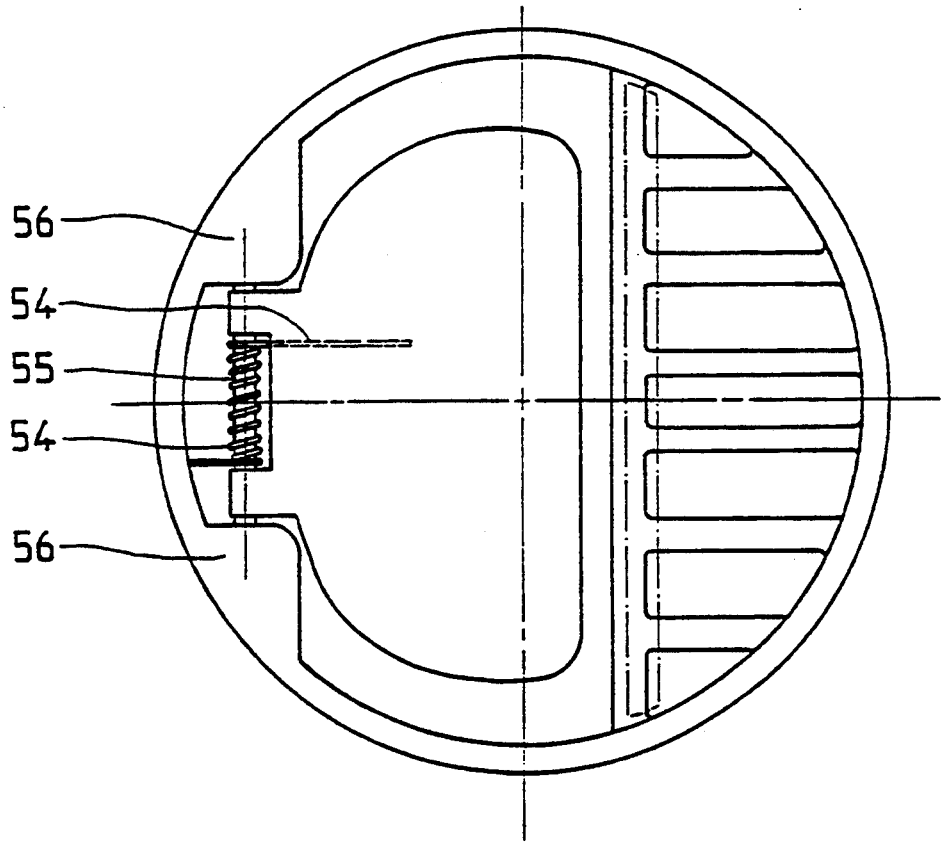
FIG. 4 is a sectional view of the regulator according to IV—IV of FIG. 2.

A foldable flap (53) is installed on wall (10), facing deflector (34). Flap (53) is movable between a horizontal position toward which it is constantly pulled by return spring (54) placed around a pivoting axis (55) of flap (53). The pivoting axis is fixed between two legs (56) integral with wall (10) (FIG. 4).

The clearance of flap (53) is such that it cannot have a shock between flap (53) and gate (16) during their respective movements, as is shown by the dotted lines of FIG. 2.

The operation of the regulator according to the invention is the following:

For slow fluid flow rates in the regulator, the liquid passes through spaces (57) between blades (36, 40) behind gate (16), then into passage (8) of body (7).

As soon as the flow rates are greater than the predetermined setting force of spring (54), flap (53) is pushed by the liquid toward the vertical position, along wall (10), and most of the liquid passes directly into passage (8), then into tank (2).

The rise of the liquid in tank (2) causes, at a certain moment, a displacement of float (13) in chamber (9). For a predetermined level of the liquid in tank (2), the upper end (48) of the rod (49) acts on lever arm(44) of catch (43) which rocks around axis (42), thereby releasing hook (47) and thereafter gate (16). The pressure of the filling liquid passing behind gate (16) is great enough to bring the latter partially in the liquid flow. At this time, gate (16) is found to be suddenly brought into its closing position, over gate seat (17) and the filling is interrupted. The filling agent is warned by standard means described in the prior art, whether or not using the shock wave effect produced by gate (16) as it closes.

When the force exerted by the liquid column on gate (16) is less than the return force of spring (21), gate (16) is brought toward the opening position and the return force of spring (21) is sufficient to lock 2hook (47) on hook (46) of catch (43) when the latter no longer thrusts against the upper end (48) of rod (49).

I claim:

1. A filling regulator for a liquid storage tank of the type having a wall defining a cavity for storing liquids therein and an opening in an upper section of the wall for permitting movement of the liquid into the cavity, said regulator comprising:

a body insertable through the tank opening and positioned at least partially within the cavity of the tank, said body comprising a wall having an inner face and an outer face, said inner face defining an interior of said body;

an inner partition located within said interior and having a top and a bottom;

a conduit for passage of the liquid through said body, said conduit located within said interior and defined by said inner partition and a first portion of said inner face; and a float chamber having a top and a bottom, located within said interior and defined by said inner partition, a second portion of said inner face, and an upper bottom extending from said top of said inner partition towards said second portion of said inner face and terminating at a position spaced apart from said second portion of said inner face, said float chamber including an opening near said bottom of said chamber, said opening extending through said second portion of said wall and defining a passage for movement of the liquid into said chamber;

a float contained within said float chamber, said float being displaced linearly in a vertical direction within said float chamber by the movement of the liquid into said flat chamber;

a gate displacable between a substantially vertical open position and a substantially horizontal closed position, said gate mounted within said interior of said body above said conduit and said float chamber;

a gate seat for receiving said gate in the closed position, said gate mounted within said interior of said body above said conduit; and a deflector located within Said interior of said body above said float chamber and sloping downwardly from an area of said inner face above said second portion of said inner face toward said inner partition, said deflector comprising a plurality of slanted, spaced apart blades including a pair of central blades, and a protective base attached to said inner face, said blades having upper ends located near said inner face and lower ends attached to said protective base, said spaced apart blades defining passages for the movement of the liquid through said deflector and behind said gate when said gate is in the open position, said deflector being sufficiently apart from said gate to permit positioning of said gate in the substantially vertical open position.

2. A regulator according to claim 1 wherein said regulator further comprises a linking plate, and wherein said central blades include prolongations extending beyond said protective base and joined together by said linking plate.

3. A regulator according to claim 2 further comprising locking means for locking said gate in the substantially vertical open position.

4. A regulator according to claim 3 wherein said locking means is releasable by upward vertical movement of said float and wherein said looking means comprise a catch pivotally mounted on an axis passing through said prolongations and a hook provided on said gate, said catch and said hook cooperating to look said gate in the substantially vertical open position.

5. A regulator according to claim 4 wherein said gate includes a stirrup pivotally mounted above said float chamber and returning means for returning said gate from the substantially horizontal closed position to the substantially vertical open position, said means being mounted on the pivoting axis of said stirrup.

6. A regulator according to claim 1 further comprising locking means for locking said gate in the substantially vertical open position.

7. A regulator according to claim 6 wherein said locking means is releasable by upward vertical movement of said float and wherein said locking means comprise a catch pivotally mounted on an axis passing through said prolongations and a hook provided on said gate, said catch and said hook cooperating to lock said gate in the substantially vertical open position.

8. A regulator according to claim 7 wherein said gate includes a stirrup pivotally mounted above said float chamber and returning means for returning said gate from the substantially horizontal closed position to the substantially vertical open position, said means being mounted on the pivoting axis of said stirrup.

9. A regulator according to claim 1 further comprising a retractable flap pivotally mounted ion a portion of said inner face above said passage conduit and facing said deflector, said deflector being displacable between a substantially horizontal position and a substantially vertical position wherein said flap obstructs the movement of the liquid into the conduit when said flap is in the horizontal position, said flap further comprising returning means for returning said flap to the substantially horizontal position.

* * * * *